US005713342A

United States Patent [19]

Simson

[11] Patent Number: 5,713,342

[45] Date of Patent: Feb. 3, 1998

[54] GAS CAPSULE MANUFACTURING PROCESS

[76] Inventor: Anton K. Simson, 13227 Aubrey St., Poway, Calif. 92064

[21] Appl. No.: 674,332

[22] Filed: Jul. 1, 1996

Related U.S. Application Data

[63] Continuation-in-part of Ser. No. 380,691, Jan. 30, 1995, Pat. No. 5,623,975.

[51] Int. Cl.[6] ..... F41B 11/00; F17C 1/00

[52] U.S. Cl. ..... 124/57; 220/581; 220/582; 220/583

[58] Field of Search ..... 124/56, 57; 220/200, 220/213, 240, 581, 582, 583, DIG. 19

[56] References Cited

U.S. PATENT DOCUMENTS

| | | | |
|---|---|---|---|
| 614,131 | 11/1898 | Read | 220/240 |
| 1,559,052 | 10/1925 | Schworetzky | 220/581 |
| 1,598,240 | 8/1926 | Carlson | 220/581 X |
| 2,181,195 | 11/1939 | McIlrath | 220/240 X |
| 2,229,739 | 1/1941 | Harrington | 220/DIG. 19 X |
| 2,258,521 | 10/1941 | Thompson | 220/582 X |
| 3,142,293 | 7/1964 | Harter | 124/57 |
| 3,258,151 | 6/1966 | Gasche | 220/582 X |
| 3,662,917 | 5/1972 | Hardingham | 220/240 X |
| 5,499,619 | 3/1996 | Tarta | 124/57 |

*Primary Examiner*—John A. Ricci
*Attorney, Agent, or Firm*—Henri J. A. Charmasson; John D. Buchaca

[57] ABSTRACT

A capsule loaded with a pressurized gas has a single front aperture sealed by an internal plug made of resilient material. The cartridge is loaded by placing it inside a pressurized chamber, then drawing the internal plug against the aperture before decompressing the chamber. A self-propelling embodiment comprises an expellable volume of liquid stored in the rear section of the cartridge in contact with its puncturable base, and separated from the pressurized gas by a floating piston. The base is concavely formed into a bell shape to focus the expelled liquid in a rearward direction.

8 Claims, 2 Drawing Sheets

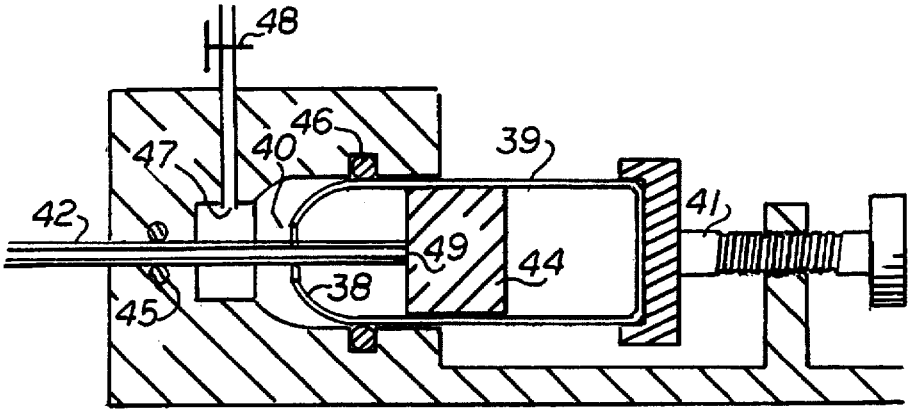
FIG. 4
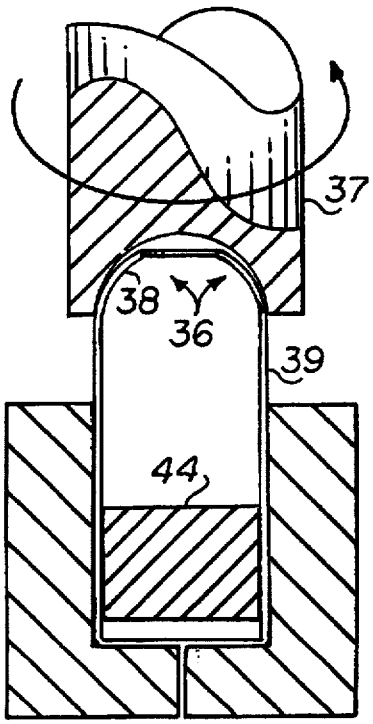
FIG. 3
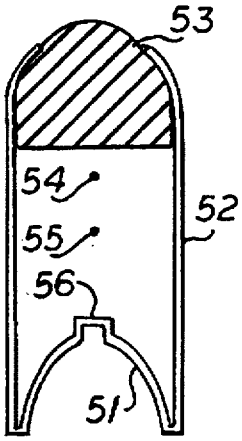
FIG. 6
FIG. 8
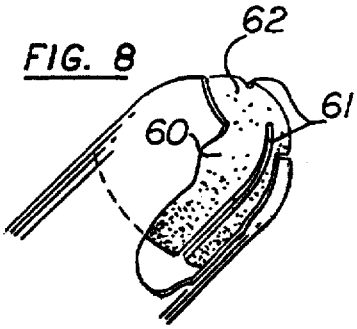
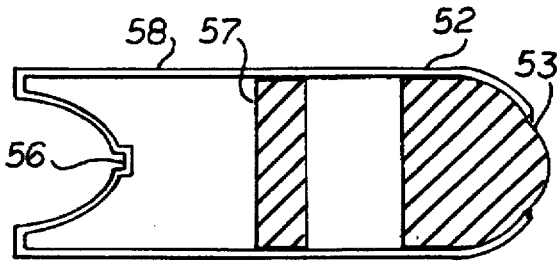
FIG. 7

GAS CAPSULE MANUFACTURING PROCESS

PRIOR APPLICATION

This is a continuation-in-part application of Ser. No. 08/380,691 filed Jan. 30, 1995 U.S. Pat. No. 5,623,975.

FIELD OF THE INVENTION

This invention relates to high pressure containers, and more specifically to the loading and sealing of high pressure gas cartridges.

BACKGROUND OF THE INVENTION

Cartridges or capsules of highly pressurized gas are used in certain high power staple guns, nail drivers and other similar tools. They are also commonly used to inflate airbags on vehicles, and as a propellant in certain non-lethal weapons. This type of cartridge usually comprises a cylindrical casing with a length of 30 millimeters (1.2 inch), and a diameter of 6 millimeters (0.24 inch). The walls of the cartridge or at least one of its ends is thin enough to be easily punctured in order to release the pressurized gas.

The loading and sealing of such a cartridge is particularly problematic when the contents is pressurized around or above 70 Atmospheres (1,030 psi). One of the most advanced methods taught by the prior art consists in soldering together two sections of the cartridge in a chamber filled with the pressurized fluid, then evacuating the chamber to retrieve the loaded cartridges. Typically, the presoldered overlapping sections of the separate portions of the cartridges are brought together in the pressurized atmosphere then heated by some induction process to melt the solder, and left to cool down before the high pressure chamber is evacuated.

In the first place, this process can not be practiced when the fluid content is pressurized to a liquid form. Secondly, the soldering may be affected by the expansion and constriction of part of the fluid around the solder-heating process, resulting in leakage or weak soldering points. Moreover, there is no practical way to verify that indeed the cartridge is properly sealed, and that no fluid has escaped during the chamber evacuation process. Similarly, there is no practical way to verify that the pressure is maintained during the life of the cartridge and that the fluid has not slowly leaked out through imperfections in the soldered interface.

While the loading of a defective cartridge in a staple gun may have little consequences, the use of a defective cartridge in an automobile airbag or a weapon may have disastrous consequences.

The present invention results from a quest for a more effective and safe process to package a highly pressurized fluid into a small cartridge.

SUMMARY OF THE INVENTION

The principal and secondary objects of this invention are to provide a safe, practical, and dependable method for packaging small volumes of highly pressurized gas into cartridges such as those used in connection with staple guns, air guns, safety airbags, and some non-lethal weapons; and to provide a convenient way to verify the integrity of the loaded cartridge after long periods of storage.

These and other objects are achieved by placing a cartridge into which has been introduced a cylindrical plug matching the inner diameter of the cartridge and made of an elastomeric material into a high pressure chamber after having swagged the open end of the cartridge to reduce its aperture, then admitting the pressurized fluid into the chamber while keeping the plug away from the cartridge aperture by means of a tubular shaft passing through a wall of the chamber and pressing against the plug. As the pressure inside the chamber increases filling the cartridge, the section of the plug contacted by the tubular shaft adheres firmly to the shaft closing its internal channel. Once the desired pressure has been reached into the chamber, the tubular shaft is partially withdrawn to draw the plug against the cartridge aperture. Further withdrawing of the tubular shaft breaks the bond between its end and the plug, allowing some fluid to escape through the central channel of the tubular shaft outside the chamber. This is a positive indication that the cartridge is fully loaded, and that the chamber can be evacuated. The slight out-bulging of the plug through the cartridge aperture is a positive indication of its pressurized status throughout the life of the cartridge.

It is also an object of the invention to provide a more efficient self-propelling cartridge by combining therein a highly compressible gas with a higher density liquid which can be expelled through the punctured back end of the cartridge under the expanding force of the gas.

BRIEF DESCRIPTION OF THE DRAWING

FIG. 3 is an illustration of a swagging process;

FIG. 4 is a cross-sectional view of an alternate embodiment of the invention;

FIG. 6 is a cross-sectional view of a self-propelling version of the cartridge;

FIG. 7 is a cross-sectional view of another version of the self-propelling embodiment of the invention; and FIG. 8 is a perspective view of an alternate embodiment of the plug.

DESCRIPTION OF THE PREFERRED EMBODIMENT OF THE INVENTION

Figure 1:
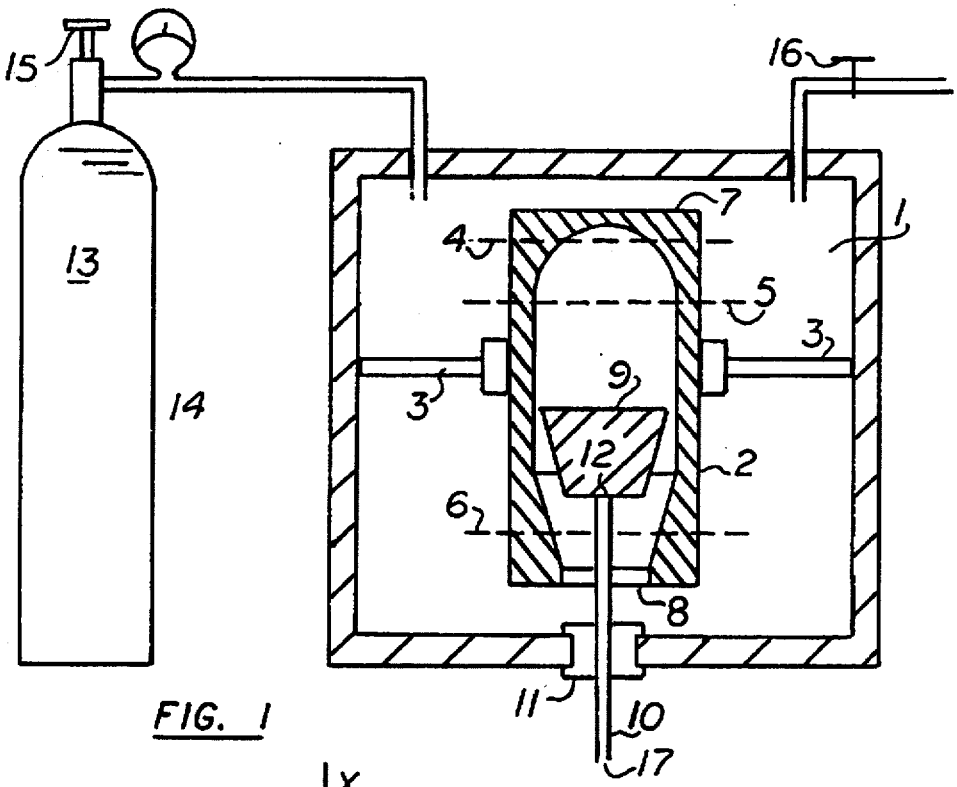
FIG. 1 is a diagrammatical illustration of the pressurized fluid packaging process.

Referring now to the drawing, there is shown in FIG. 1 a pressure chamber 1 within which a vessel 2 to be filled with a pressurized fluid is being held by a clamping mechanism 3. The vessel 2 has a plurality of circular cross-sections 4,5, and 6, a closed end 7, and an opposite open end defining an aperture 8. The aperture 8 is smaller than at least the largest cross-section 4. The vessel contains a plug 9 made of elastomeric material and having a plurality of circular cross-sections, at least one of which is larger than the aperture 8. A tubular shaft 10, slidingly passing through a hermetical seal 11 in a wall of the chamber 1, has an open end 12 in contact with the plug 9. A highly pressurized fluid 13 is admitted into the chamber 1 from a pressurized fluid source 14 by opening an intake valve 15 while an exhaust valve 16 is kept closed. The hollow shaft 10 is moved inwardly to keep the plug 9 away from the aperture 8. As the pressurized fluid fills the chamber, it also fills that portion of the vessel which is not occupied by the plug. The difference in pressure between the inside of the chamber and the outside ambient atmosphere where the opposite open 17 end of the tubular shaft is located causes the section of the plug in contact with the internal open end 12 of the tubular shaft to tightly adhere to that end and prevent any pressurized fluid from escaping through the central channel of the tubular shaft 10.

As the tubular shaft is partially withdrawn the plug is forced to move by the imbalanced pressure force acting on it and comes to rest against the opening 8 of the vessel, closing it. As the tubular shaft continues to be withdrawn, its internal open end 12 separates from the plug that is now immobilized into the opening of the vessel. Some of the pressurized fluid begins escaping through the internal channel of the tubular shaft indicating that the vessel is now full and sealed. The intake valve 15 is closed and the exhaust valve 16 open to evacuate the pressurized fluid from the chamber, and the loaded vessel can be retrieved.

Figure 2:
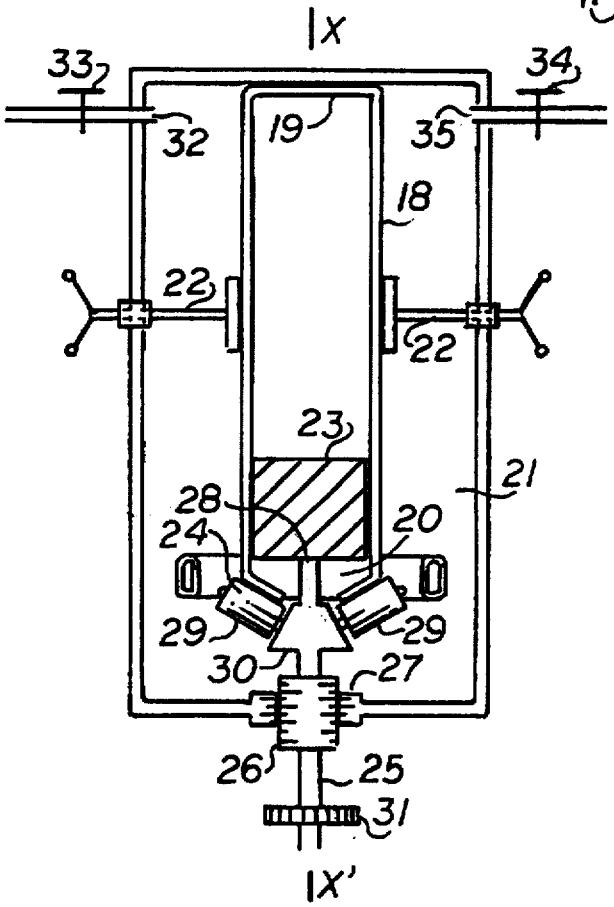
FIG. 2 is a cross-sectional illustration of an apparatus used to implement said process.

The preferred embodiment of the invention is illustrated in FIGS. 2, 3, and 4.

As shown in FIG. 2, a cylindrical cartridge 18 having a closed end 19 and an opposite open end 20 is held within a pressure chamber 21 by a clamping mechanism 22. A cylindrical plug 23, made of elastomeric material and having a length approximately equal to its diameter which is approximately 0.75 millimeter (0.005 inch) less in diameter than the internal diameter of the cartridge, is inserted all the way into the cartridge. The open end 20 of the cartridge is then constricted by swagging-in the rim 24 of the cartridge to an angle between 30 and 80 degrees in reference to the axis of the cartridge. The swagging operation is accomplished by a mechanism comprising a tubular shaft 25 having a finely threaded section 26 meshing with a threaded bearing 27 coaxial with the cartridge. The distal end 28 of the tubular shaft extends into the cartridge to contact the plug 23. Two or more rollers 29 are mounted inside the chamber on a yoke 30 fixed to the tubular shaft proximate the cartridge aperture 20. The rollers are slanted to the desired swagging angle. The tubular shaft and roller mechanism are rotated clockwise through an external gear 31. As the tubular shaft slowly advances within the loaded cartridge, the roller 29 begins to bend the rim 24 of the cartridge inwardly until the diameter of the aperture 20 is reduced to about one-third of the internal diameter of the cartridge. At that point, a pressurized fluid is admitted through the intake port 32 by means of valve 33 while the valve 34 of the exhaust port 35 is kept shut. The pressurized fluid flows into the cartridge seeping between the plug 23 and the cartridge internal walls. As the pressure builds into the chamber the part of the plug contacted by the tubular shaft is pressed firmly against the latter. The tubular shaft 25 is then rotated counter-clockwise in a withdrawing movement which drags the plug 23 seats firmly against the swagged rim 24. As the tubular shaft 25 continues to withdraw, the bond between the plug and the distal end of the shaft 28 is broken, allowing some of the fluid to escape to the outside of the chamber via the internal channel of the tubular shaft. This is an indication that the cartridge has been fully loaded. The chamber is now evacuated by closing the intake valve 33 and opening the exhaust valve 34. The chamber 21 can now be opened to retrieve the loaded cartridge.

Figure 5:
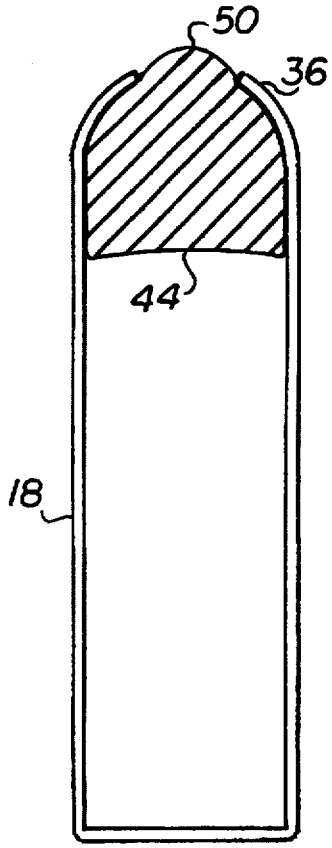
FIG. 5 is a cross-sectional view of a loaded cartridge.

In an alternate preferred embodiment of the invention illustrated in FIGS. 3, 4 and 5, the rim is swagged into a hemispherical configuration 36. The hemispherical shape, with an ever increasing angle of its surface to the axis of the cartridge, prevents the elastomeric plug from assuming a skewed orientation with the cartridge axis. The previously-described conical swagged end can cause the elastomeric plug to orient itself with one of its sides sliding down the side of the cone and resulting in an imperfect seal.

As shown in FIG. 3, the hemispherical swagging operation is accomplished by use of a concave hemispherically shaped steel die 37 being spun at high speed and forced down over the rim of the open end of the cartridge. The frictional heat and pressure of the spinning die produces a smooth, curved, crack-free reduction in the cartridge opening. The swagging is continued until the opening is reduced to a diameter approximately 40% to 50% of the original opening diameter.

As shown in FIG. 4, pressurization of the cartridge is accomplished by inserting the swagged end 38 of the cartridge 39 into a pressure chamber 40 and clamping the cartridge into position by means of clamping mechanism 41. A tubular shaft 42 is moved inward along the axis of the cartridge so that its distal end 28 extends into the cartridge and contacts the plug 44. The tubular shaft penetration into the pressure chamber is sealed by an O-ring 45. The cartridge penetration into the pressure chamber is sealed by another O-ring 46.

At that point, a pressurized fluid is admitted through the intake port 47 by means of valve 48. The pressurized fluid flows into the cartridges seeping past the plug 44. As the pressure builds into the chamber and cartridge, the central part of the plug is pressed against the end of the tubular shaft 42. The latter is then withdrawn until the plug seats firmly against the hemispherical rim 38. As the tubular shaft is further withdrawn, the bond between the plug and the distal end of the shaft 49 is broken, allowing some of the fluid to escape to the outside of the chamber via the internal channel of the tubular shaft.

As in the previously-described embodiment, this is an indication that the cartridge is fully filled. The chamber is now evacuated by closing the intake valve 48 and allowing the fluid to escape out through the tubular shaft. The clamp 41 can now be released to free the cartridge.

FIG. 5 illustrates a loaded cartridge where the top of the plug 44 has been deformed under the push of the internal pressurized fluid to follow the internal contour of the hemispherically swagged rim 36, and to form a central bulging section 50. That bulging section is a positive indication during the shelf-life of the cartridge that it maintains its internal pressure.

The cartridge is preferably made of a metal or alloy with a ductility falling between the ductility of copper and that of stainless steel such as brass. The thickness of the cartridge wall is approximately 0.3 millimeter (0.012 inch). The plug 49 is made by cutting small sections of a rod of an elastomeric material having a specific weight of about 2 such as a Viton brand of elastomers.

The cartridge can also be manufactured by molding a thermo-plastic material. In such case a heating element may be used around the rim of the cartridge to mollify it during the swagging process.

It should be understood that the mechanisms described in FIGS. 2, 3 and 4 do not limit the way of practicing the invention. The swagging and filling process can be accomplished at separate stations in an assembly line operation.

A second alternate embodiment of the invention is shown in FIG. 6. Here the back of closed end 51 of the cartridge 52 has been concavely formed in the bell-shape of the diverging section of a supersonic nozzle. In addition, the elastomers plug 53 includes heavy materials to increase its density. These materials may be in the form of high density particles (e.g., lead) molded into the elastomers or a single weight molded into the elastomers to increase its average density. The corresponding average specific gravity of the elastomeric plug is then increased to approximately 5 or greater and is used to assure that the center of gravity 54 of the entire cartridge is substantially forward of the center of the drag 55.

When the cartridge is mounted in a rifle-type mechanism and the entrance 56 of the nozzle 51 is punctured by an external pin, fluid enclosed in the cartridge will be expelled from the cartridge and drive the entire cartridge as a self-propelled projectile.

FIG. 7 illustrates an improved version of the self-propelling cartridge or capsule shown in FIG. 6.

Using the same type of cartridge 52, with a bell-shaped closed end 51, a piston 57 preferably made of elastomeric material, is slidingly placed between the plug 53 closing the tip aperture and the closed end 51. The plug 53 is cylindrical with a cross-section substantially symmetrical to the internal cross-section of the main body of the cartridge.

A liquid 58 such as water or any other suitable liquid of a higher specific density is held between the piston 57 and the closed end 51 of the cartridge. The compressed gas 59 occupies space between the piston 57 and the plug 53. When the tip 56 of the closed end of the cartridge is punctured, the liquid 58 is expelled as the gas 59 expands and moves the piston toward the closed end.

The expelling of the higher density liquid through the punctured, bell-shaped back end provides a more powerful propelling force than would the expelling of the lower density gas. By allowing proper adjustment of the relative volume of gas and liquid, the invention can yield optimal performance taking advantage of the compressibility of the gas and the higher density of the liquid.

The filling process of this version of the cartridge is similar to the ones above-described, except that the liquid is first loaded into the tail part of the cartridge and sealed with the piston before placing the capsule with its internal floating plug into the compressed gas chamber.

FIG. 8 illustrates an alternate version of the elastomeric plug partially exposed through the aperture and through a cutout in the upper section of the cartridge. The plug 60 having one or more grooves or channels 61 cut into its outer surface and running from the area 62 exposed through the aperture of the loaded capsule to the back end 63 of the plug. The size and number of the grooves 61 can be adjusted to establish a predictable fluid-leaking rate, thus creating a time release cartridge having a variety of applications.

While the preferred embodiments of the invention have been described, modifications can be made and other embodiments may be devised without departing from the spirit of the invention and the scope of the appended claims.

What is claimed is:

1. A pressurized fluid capsule which comprises a vessel having substantially circular internal cross-sections, a single aperture smaller than the largest of said cross-sections and a closed end opposite said aperture;

a plug made of elastomeric material and having a front end, a back end, and substantially circular cross-sections, a least one of said plug cross-sections being larger than said aperture and smaller than said vessel largest cross-section;

said plug being positioned inside said vessel and having a portion of said front end closing said aperture;

at least one pressurized fluid held within said vessel and forcefully pushing said portion against said aperture.

2. The capsule of claim 1, wherein said plug has a groove extending from a section of said portion closing said aperture to said back end, said groove being shaped and dimensioned to allow a slow and controlled leakage of said fluid past said plug through said aperture.

3. The cartridge of claim 1, wherein said circular internal cross-sections are substantially symmetrical and said cartridge further comprises:

a cylindrical piston having a cross-section substantially symmetrical with said circular internal cross-sections, and being slidingly positioned between said plug and said back end; and wherein said at least one fluid comprises a gas compressed between said plug and said piston, and a second fluid having a higher density than said gas and being compressed between said piston and said closed end;

whereby once said closed end is punctured, said second fluid is expelled from said capsule as said gas expands and moves said piston toward said punctured end.

4. The cartridge of claim 3, wherein said gas comprises air, and said second fluid is selected from a group consisting of water and liquids having a specific density higher than one.

5. The cartridge of claim 3, wherein said piston is made of elastomeric material.

6. A self-propelling, pressurized fluid cartridge which comprises:

a cylindrical vessel having a circular cross-section, a closed base, and a front end, said front end having an aperture smaller than said cross-section and coaxial with said vessel;

a plug of elastomeric material inserted within said vessel and having a portion closing said aperture;

a first volume of liquid occupying a back area of said vessel bounded by said base;

a second volume of compressed gas occupying a front area of said vessel bounded by said plug; and a piston having a cross-section commensurate with said circular cross-section and being slidingly mounted between said first and second volumes.

7. The cartridge of claim 6, wherein said closed base is concavely formed into a bell-shape coaxial with said vessel.

8. The cartridge of claim 7, wherein said closed end comprises a central puncturable area at the apex of said bell-shape.

* * * * *